United States Patent [19]

Lukehart et al.

[11] 4,367,689

[45] Jan. 11, 1983

[54] WATER RECREATIONAL VEHICLE

[76] Inventors: Leonard J. Lukehart; Vernon H. Sietmann, both of Laurel, Iowa 50141

[21] Appl. No.: 181,868

[22] Filed: Aug. 27, 1980

[51] Int. Cl.[3] ..... B63B 35/72

[52] U.S. Cl. ..... 114/346; 440/6

[58] Field of Search ..... 9/1.1, 1.3, 11 R, 2 A, 9/2 C, 11 A; 440/111, 6, 3, 80, 83, 53, 86; 114/123, 270, 346; 441/40

[56] References Cited

U.S. PATENT DOCUMENTS

| | | | |
|---|---|---|---|
| 2,058,383 | 10/1936 | Maynes . | |
| 2,919,392 | 12/1959 | Smith . | |
| 3,045,262 | 7/1962 | Mitchell | 9/1.1 |
| 3,382,513 | 5/1968 | Jennings | 9/1.3 |
| 3,387,582 | 6/1968 | Reeves | 440/6 |
| 3,685,481 | 8/1972 | Mansell . | |
| 3,718,111 | 2/1973 | Del Vecchio . | |
| 3,850,132 | 11/1974 | Jackson | 9/1.3 |
| 3,906,887 | 9/1975 | Kappas | 440/6 |
| 4,021,873 | 5/1977 | Francois | 9/1.3 |
| 4,066,032 | 1/1978 | Travis | 440/53 |

*Primary Examiner*—Trygve M. Blix
*Assistant Examiner*—Harry A. Smith
*Attorney, Agent, or Firm*—Zarley, McKee, Thomte, Voorhees & Sease

[57] ABSTRACT

The water recreational vehicle of the present invention consists of a rigid housing mounted on a floatatable tube. The vehicle is powered by two hand operated battery powered motors with propellers. The vehicle is designed to have increased ballast and maneuverability.

1 Claim, 4 Drawing Figures

WATER RECREATIONAL VEHICLE

BACKGROUND OF THE INVENTION

A standard inner tube has long been used as a water recreational vehicle. It has been adapted in many ways to provide increased recreational uses. Control of the tube and its many adaptations has long been a problem. Maneuverability of a tubular vehicle has also been somewhat limited and a further problem. Also, in the adaptations of the standard inner tube when a person is seated above the level of the inner tube, the stability and ballast of the tube has often been of concern. Overall safety is a primary concern of every aquatic vehicle.

SUMMARY OF THE INVENTION

The present invention utilizes a rigid housing mounted upon a tube constructed of plastic or metal filled with floatational material such as foam core, or a tube constructed of inflatable rubber. Surrounding the tube is a protective docking bumper. At least one swivel seat is attached to the rigid housing. Two hand operated battery controlled motors with propellers are also mounted on the rigid housing. These motors are mounted so as to be rotatable 360° in both a clockwise and counterclockwise direction. The motors each have a control for variable speeds as well as a control for both forward and reverse directions. The batteries for the motors are located beneath the seats and at a level beneath the water level so as to provide additional ballast for the vehicle. The two motors are mounted with standard double clamp mounts on either side of the center point of the vehicle and provide great maneuverability.

Accordingly, a primary object of this invention is to provide a water recreational vehicle with improved maneuverability, stability and ballast.

A further object of this invention is the provision of a vehicle which can be used by one or more people.

A further object of this invention is the provision of a vehicle which moves forward and rearward and can also be rotated about its axis. A further object of this invention is the provision of a vehicle which is battery powered.

A further object of this invention is the provision of a vehicle which can be easily transported between bodies of water.

A still further object of the invention is to provide a vehicle that is easy to operate, durable in use and economical to manufacture.

DETAILED DESCRIPTION OF THE DRAWINGS

Figure 1:
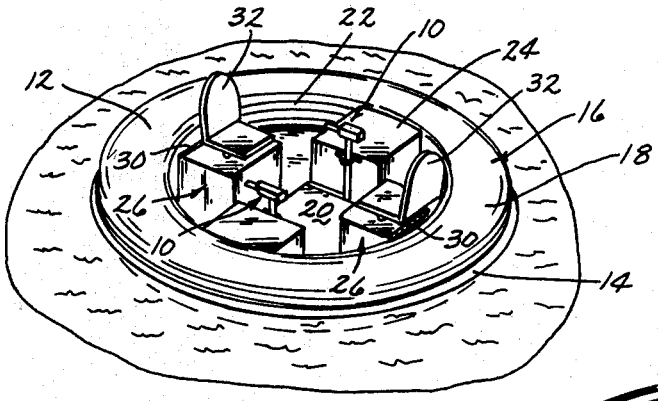
FIG. 1 is a perspective view of the vehicle.

Referring to the drawings, numeral 10 generally designates the motor. The tube 12 is surrounded about its circumference by a docking bumper 14. The tube is filled with air and/or a floatation material such as foam core.

The housing 16 has an upper surface 18, which is the upper portion of the tube, a floor 20 and a side wall 22. The floor 20 and side wall 22 extend through the center of tube 12 to a level approximately the same as that of the bottom of the tube. The precise connection (not shown) between side wall 22 and tube 12 can assume various configurations, and does not comprise a part of this invention. The housing 16 has attached to it a mounting stand 24 for each of the motors and a battery compartment 26 for each of the batteries. Each battery compartment has a lid 28 and a hinge 30 for mounting the lid. The lid 28 also serves as a mount for the swivel seat 32. The battery 34 sits on the floor 20 of the battery compartment 26 at a level below the surface of the water. This low weight distribution provides increased ballast for the vehicle.

Figure 4:
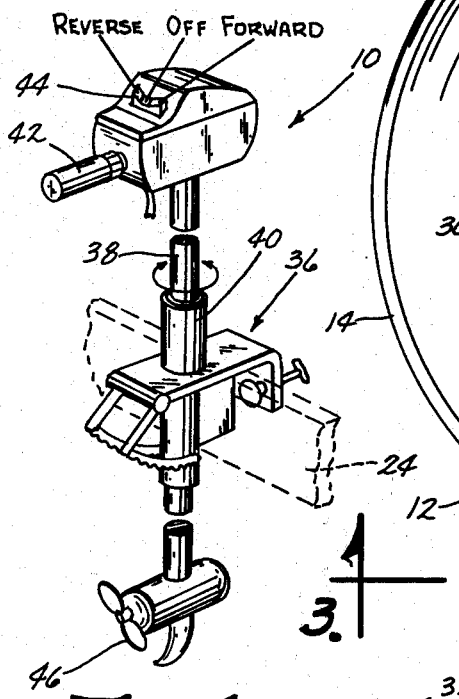
FIG. 4 is a perspective view of a motor.
Figure 2:
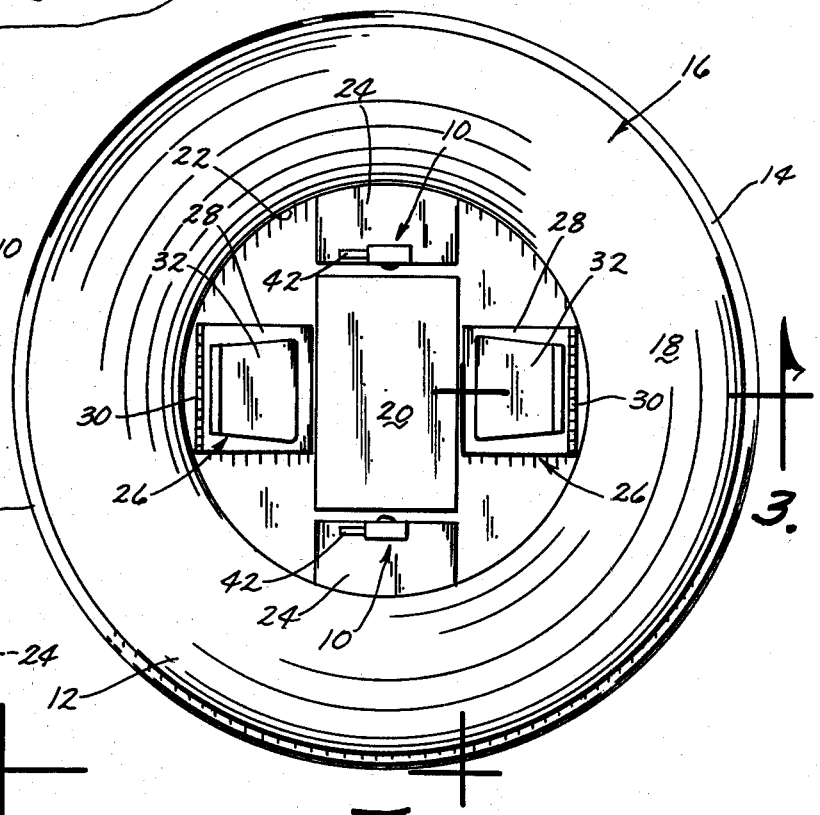
FIG. 2 is a top plan view of the vehicle.
Figure 3:
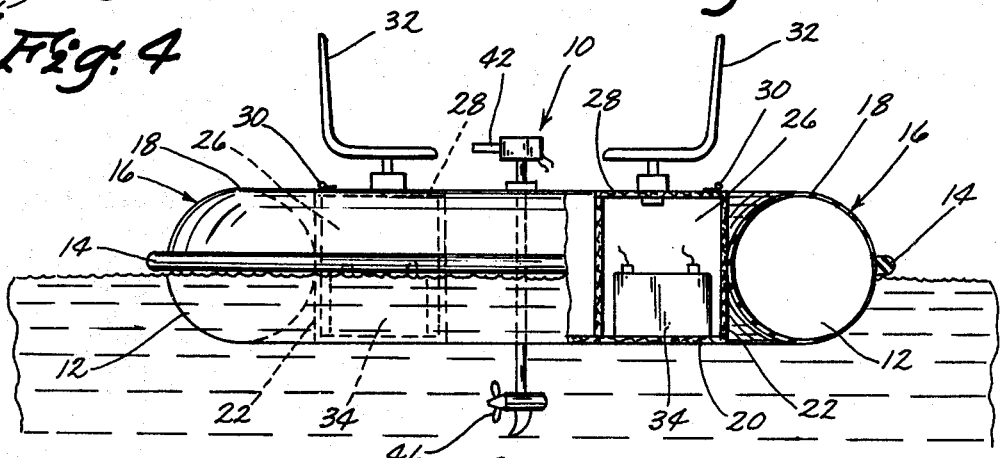
FIG. 3 is an elevational and sectional view of the vehicle taken along line 3—3 of FIG. 2.

Referring to FIG. 4, the motor 10 has a standard double clamp mounting means 36. The shaft 38 of the motor rotates 360° in both the clockwise and counterclockwise direction within the collar 40. The motor has a hand control 42 which controls the variable speeds of the motor. The motor has a forward and reverse switch which controls the direction of rotation of the propeller 46.

In operation, the vehicle is easily maneuvered by the two motors. The vehicle can go in forward or reverse directions, can turn, and can spin about its axis. To turn the vehicle, one motor can be turned on low and the other motor turned on high. The vehicle can also be turned by rotating one or both motors about their axis 38. To spin the vehicle about its axis, both motors are run at the same speed with one motor being in the forward gear and the other motor being in the reverse gear.

It therefore can be seen that the vehicle of the present invention accomplishes all of its stated objectives.

We claim:

1. A water recreational vehicle comprising:

a floatable circular tube having a geometric centerpoint defining a center axis, a longitudinal axis, and a lateral axis, a rigid housing shell mounted on said tube, two hand controlled battery powered outboard motors mounted within said rigid housing and being symmetrically positioned on opposite sides of said centerpoint on said lateral axis, two oppositely facing seats mounted within said rigid housing and being symmetrically positioned on opposite sides of said centerpoint on said longitudinal axis, clamp means mounting said motors to said housing and permitting rotation of said motors about a vertical axis in either a clockwise or counterclockwise direction, a control means on each of said motors to permit selective control of the speed of said propellers and the direction of rotation of said propellers, said tube being free from protrusions on its outer perimeter to permit easy rotation thereof about said axis when in a floating condition by causing one propeller to rotate in a clockwise direction and causing the other propeller to rotate in a counterclockwise direction.

* * * * *